US007891507B2

(12) United States Patent
Shetler

(10) Patent No.: US 7,891,507 B2
(45) Date of Patent: Feb. 22, 2011

(54) STORAGE RACK DECKING DERIVED FROM A SINGLE SHEET OF SHEET METAL

(76) Inventor: Jakie Shetler, P.O. Box 192, Cochranton, PA (US) 16314

( * ) Notice: Subject to any disclaimer, the term of this patent is extended or adjusted under 35 U.S.C. 154(b) by 438 days.

(21) Appl. No.: 11/961,191

(22) Filed: Dec. 20, 2007

(65) Prior Publication Data

US 2009/0159545 A1 Jun. 25, 2009

(51) Int. Cl.
*A47F 5/00* (2006.01)

(52) U.S. Cl. ..... 211/135

(58) Field of Classification Search ..... 211/153, 211/183, 134, 187, 186, 189; 52/630, 450, 52/220.4, 180, 336, 636, 660; 428/182, 132; 108/51.3, 53.1, 51.11, 901, 902; 72/379.2; 29/897.32

See application file for complete search history.

(56) References Cited

U.S. PATENT DOCUMENTS 1,073,151 A * 9/1913 Matthew ..... 34/238
1,979,902 A * 11/1934 Potter et al. ..... 211/153
2,381,608 A * 8/1945 Leyerle ..... 34/238
2,606,806 A * 8/1952 Giffard ..... 312/350
2,648,105 A * 8/1953 Kurtz ..... 52/75
2,918,176 A * 12/1959 Bell et al. ..... 211/191
3,018,862 A 1/1962 Litteral et al.
3,042,221 A 7/1962 Rasmussen
3,285,428 A 11/1966 Scheck
3,349,924 A 10/1967 Maurer et al.
3,463,325 A 8/1969 Zagozza et al.
3,556,309 A * 1/1971 Schreyer et al. ..... 211/153
3,571,998 A * 3/1971 Iacona ..... 52/478
3,643,607 A * 2/1972 MacKenzie ..... 108/180
3,724,078 A 4/1973 Carlin et al.
3,762,344 A * 10/1973 Chez ..... 108/57.29
3,814,034 A * 6/1974 Seiz ..... 108/187
3,846,944 A * 11/1974 Lambert ..... 52/236.3
3,986,462 A * 10/1976 Heft ..... 108/188
4,048,059 A 9/1977 Evans
4,056,195 A * 11/1977 Keith ..... 211/153
4,078,664 A 3/1978 McConnell
4,182,080 A * 1/1980 Naylor ..... 49/410
4,186,535 A * 2/1980 Morton ..... 52/250
4,333,280 A * 6/1982 Morton ..... 52/167.1
4,453,283 A 6/1984 Fitzgerald-Smith et al.
4,709,642 A * 12/1987 Briosi ..... 108/187
4,757,769 A * 7/1988 Suttles ..... 108/190
4,815,394 A * 3/1989 Ettlinger et al. ..... 108/107

(Continued)

*Primary Examiner*—Jennifer E. Novosad
(74) *Attorney, Agent, or Firm*—Jonathan M. D'Silva; MacDonald, Illig, Jones & Britton, LLP

(57) ABSTRACT

Decking for a storage rack system is presented in which the decking is formed from a single sheet of sheet metal. The single sheet of sheet metal is cut and folded to form a plurality of parallel deck members having an upper deck surface, a lower deck surface, and sidewalls. The single sheet of sheet metal further folded to form two cross rails perpendicular to the deck members at either end of the deck members. Each cross rail comprises a lower rail surface and a side rail surface. Each lower rail surface overlaps at least a portion of the lower deck surface of the deck members. The lower rail surfaces are secured to the lower deck surface at the overlap of the lower rail surface and the lower deck surface.

10 Claims, 14 Drawing Sheets

U.S. PATENT DOCUMENTS 4,843,975 A * 7/1989 Welsch et al. ..... 108/24
4,955,490 A * 9/1990 Schafer ..... 211/187
4,964,350 A * 10/1990 Kolvites et al. ..... 108/110
4,995,323 A 2/1991 Kellems et al.
D319,362 S * 8/1991 Kellems et al. ..... D6/511
5,199,582 A 4/1993 Halstrick
5,271,337 A 12/1993 Kolvites et al.
5,279,431 A 1/1994 Highsmith et al.
5,628,415 A 5/1997 Mulholland
6,050,428 A * 4/2000 Hollander ..... 211/186
6,079,339 A * 6/2000 Houk et al. ..... 108/186
6,112,472 A * 9/2000 Van Dyk et al. ..... 52/36.1
6,286,693 B1 * 9/2001 Brown ..... 211/181.1
6,401,944 B1 6/2002 Kircher et al.
6,520,353 B2 * 2/2003 Fulbright ..... 211/153
7,156,243 B2 * 1/2007 Henning et al. ..... 211/153
7,228,978 B2 * 6/2007 Cross ..... 211/153
7,534,501 B2 * 5/2009 Durney ..... 428/596
2004/0251224 A1 12/2004 Kircher et al.
2004/0251225 A1 12/2004 Cross
2005/0150852 A1 7/2005 Henning et al.
2006/0060550 A1 3/2006 Cross
2010/0000952 A1 * 1/2010 McKinney et al. ..... 211/135

* cited by examiner

STORAGE RACK DECKING DERIVED FROM A SINGLE SHEET OF SHEET METAL

BACKGROUND

Storage rack systems typically comprise a series of vertical columns with braces installed across adjacent pairs of columns. Horizontal step beams link braced pairs of columns to form a storage framework. The horizontal step beams are spaced at vertical intervals to create multi-tiered storage bays. Various types of decking have been used to create storage shelves onto which product may be stored or displayed on storage bays.

SUMMARY

Decking is provided for storage rack systems. Suitable storage rack systems comprise a plurality of vertical columns and a plurality of horizontal step beams that define at least one storage bay. Each horizontal step beam has a lip onto which the decking is mounted to form a storage shelf. The decking comprises a single sheet of sheet metal folded cut and folded to form a plurality of parallel deck members. Each deck member has an upper deck surface, a lower deck surface, and sidewalls. The single sheet of sheet metal is further folded to form two cross rails perpendicular to the deck members. The cross rails are located at either end of the deck members and comprise a lower rail surface and a side rail surface. Each lower rail surface overlaps at least a portion of the lower deck surface of the deck members. The lower rail surfaces are secured to the lower deck surfaces at their overlap.

Those skilled in the art will realize that this invention is capable of embodiments that are different from those shown and that details of the structure of the decking can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
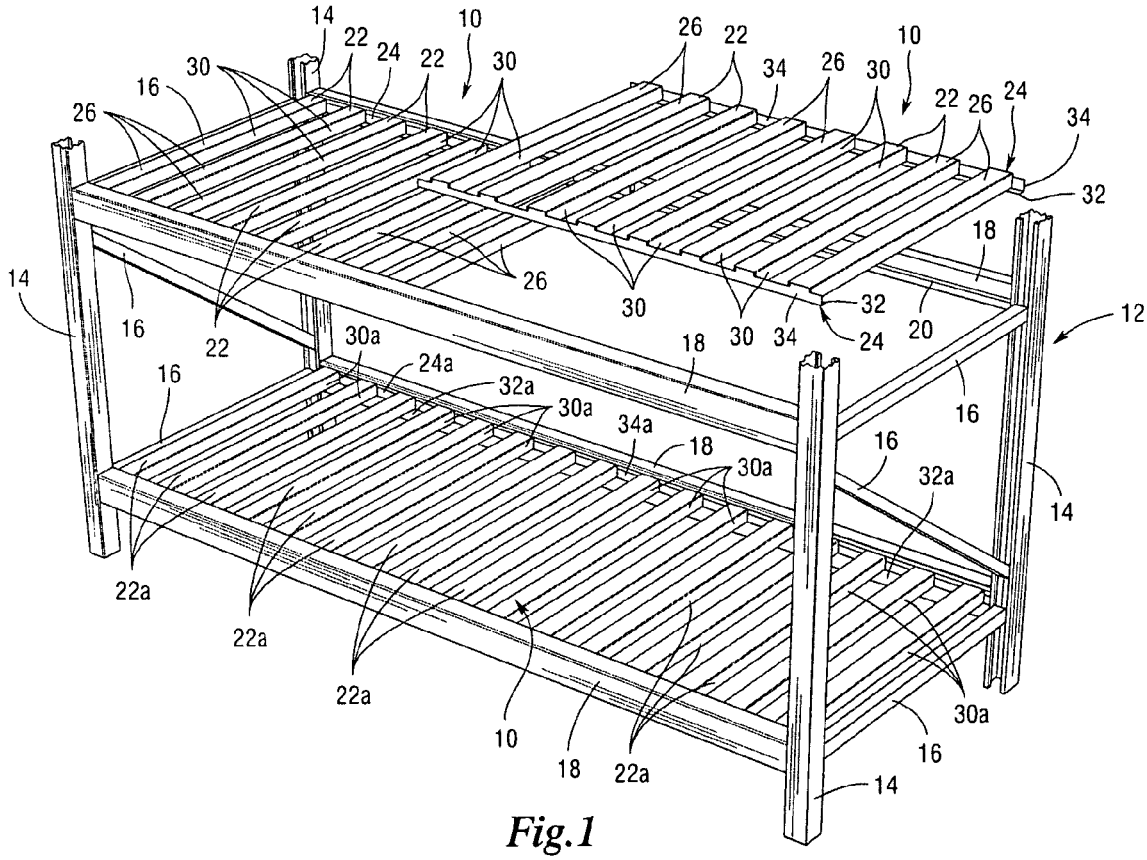
FIG. 1 is a perspective view of a storage rack system with two storage bays with two embodiments of the decking installed.

Referring to the drawings, some of the reference numerals are used to designate the same or corresponding parts through several of the embodiments and figures shown and described. Corresponding parts are denoted in specific embodiments with the addition of lowercase letters. Variations of corresponding parts in form or function that are depicted in the figures are described. It will be understood that generally variations in the embodiments can be interchanged without deviating from the invention.

FIG. 1 shows two embodiments of the decking 10 and 10*a* installed on a storage rack system 12. Storage racks typically comprise a plurality of vertical columns 14 with pairs of adjacent columns connected by braces 16. Pairs of adjacent vertical columns 14 are connected by horizontal step beams 18 to define storage bays. The horizontal step beams 18 typically have a lip 20 onto which shelving or decking units may be mounted to create storage shelves. Storage rack systems 12 are often not supplied with shelves or decking, leaving the style of shelf or decking as a customization choice for end users. The dimensions of the columns 14, braces 16, and horizontal step beams 18 vary by manufacturer and application.

FIG. 1 shows the decking 10 mounted on the storage rack system 12 by simply placing decking 10 of appropriate dimensions onto the lip 20 of the higher pair of horizontal step beams 18. The decking 10 may be fastened to the storage rack system (not shown) if required in any appropriate fashion, for example, with spot welds, glue, screws, bolts, clamps, etc. FIG. 1 also shows decking 10*a* having a different length installed on the lower pair of horizontal step beams 18 on the same storage rack system 12 to illustrate that the decking 10 can be made to any dimension required for the particular configuration of storage rack system 12. The assembled decking 10, when properly installed on a storage rack system 12, creates a storage shelf that is free of protuberances that may snag product during loading and unloading and has few sharp edges that may damage product or harm users.

Figure 2A:
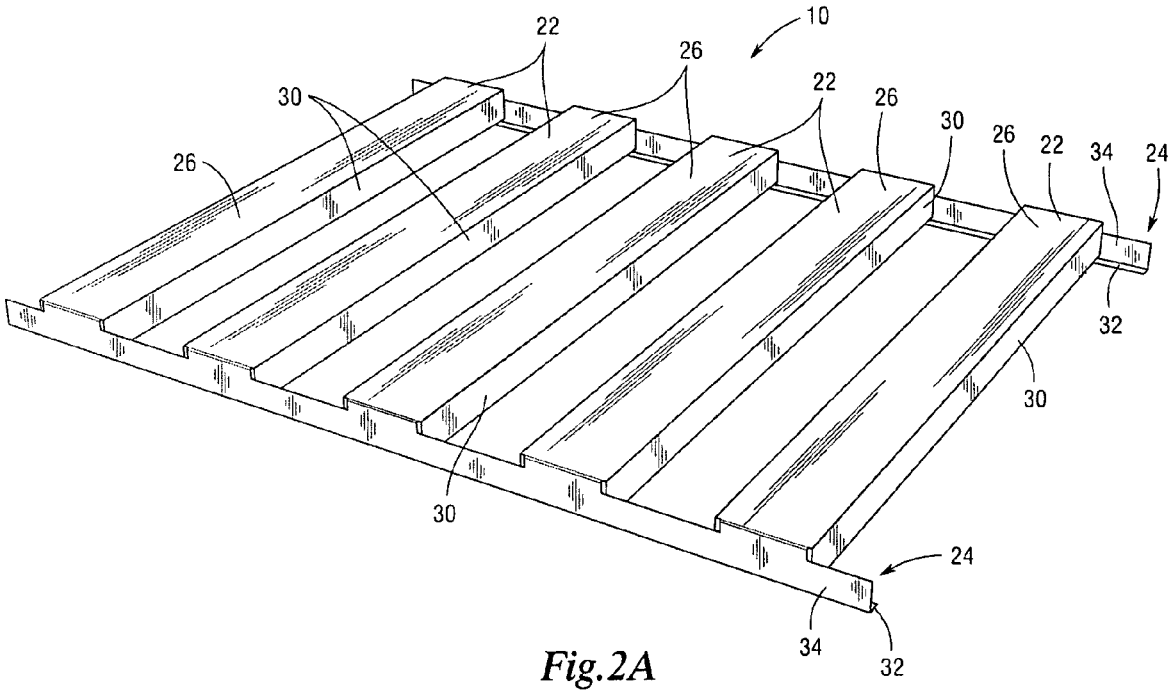
FIG. 2A is a perspective view of an embodiment of the decking.
Figure 2B:
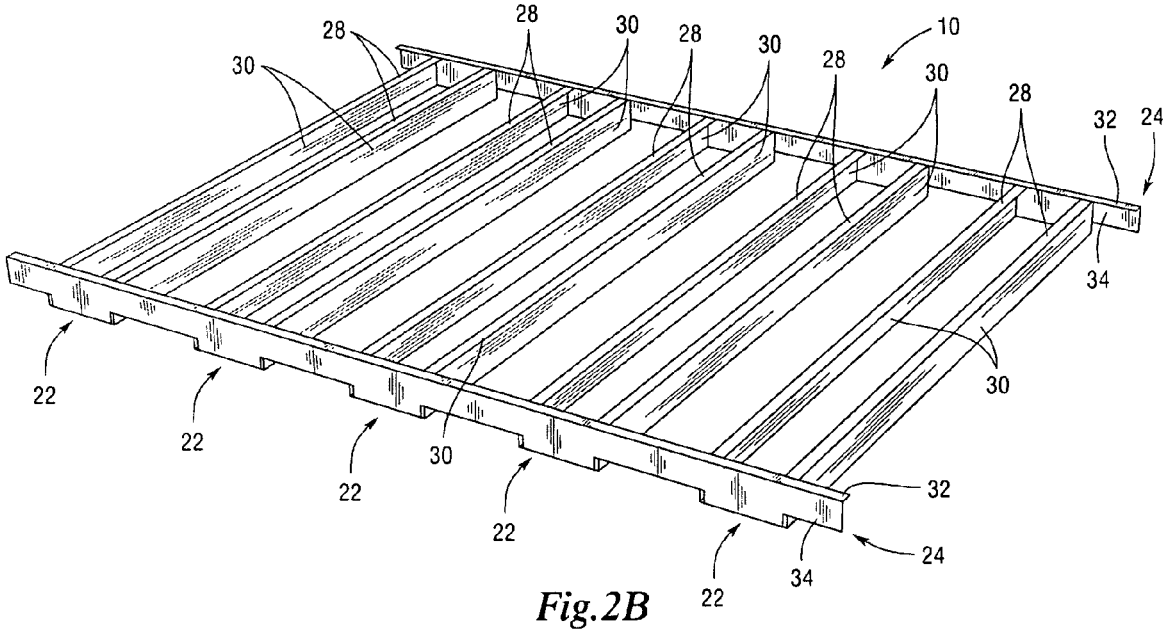
FIG. 2B is a perspective view showing the underside of the decking of FIG. 2A.

As best understood by comparing FIGS. 1 through 2B, the decking 10 is formed from a single sheet of metal that is cut, folded, and secured in to shape. The decking 10 comprises a plurality of parallel deck members 22 connected by a pair of parallel cross rails 24 that are perpendicular to and on either end of the deck members 22. Each deck member 22 has an upper deck surface 26 that defines the top of the decking 10 onto which product is stored in a storage rack system 12.

Each cross rail 24 has a side rail surface 34 and a lower rail surface 32. The deck members 22 have sidewalls 30 along the thickness of the decking 10. As shown in FIG. 2B, each deck member 22 has a lower deck surface 28 underneath the decking 10. The lower rail surfaces 32 overlap a portion of the lower deck surface 28 of the deck members 22. The lower rail surface 32 is secured to the lower deck surfaces 28 of each deck member 22 at this overlap by any of a variety of methods including, but not limited to, spot welding, riveting, crimping, bolting, screwing, nailing, etc.

As best understood by comparing FIGS. 2A through 3E, the decking 10 is formed from a single sheet of sheet metal 36 that is cut, folded, and secured to form the decking 10. First a series of rectangular holes 38 in two lines parallel to one another are cut out of the sheet metal 36 as shown in FIG. 3A. Each rectangular hole 38 has an inner edge 40 towards the middle of the sheet of sheet metal 36, an outer edge 42 away from the middle of the sheet of sheet metal 36, and sides 44. The distance between the two lines of rectangular holes 38 parallel to one another is the length of the deck members 22 of the decking 10 shown in FIG. 2A. The length of each rectangular hole 38 defines the space between the deck members 22 of the decking 10 shown in FIG. 2A.

Figure 3A:
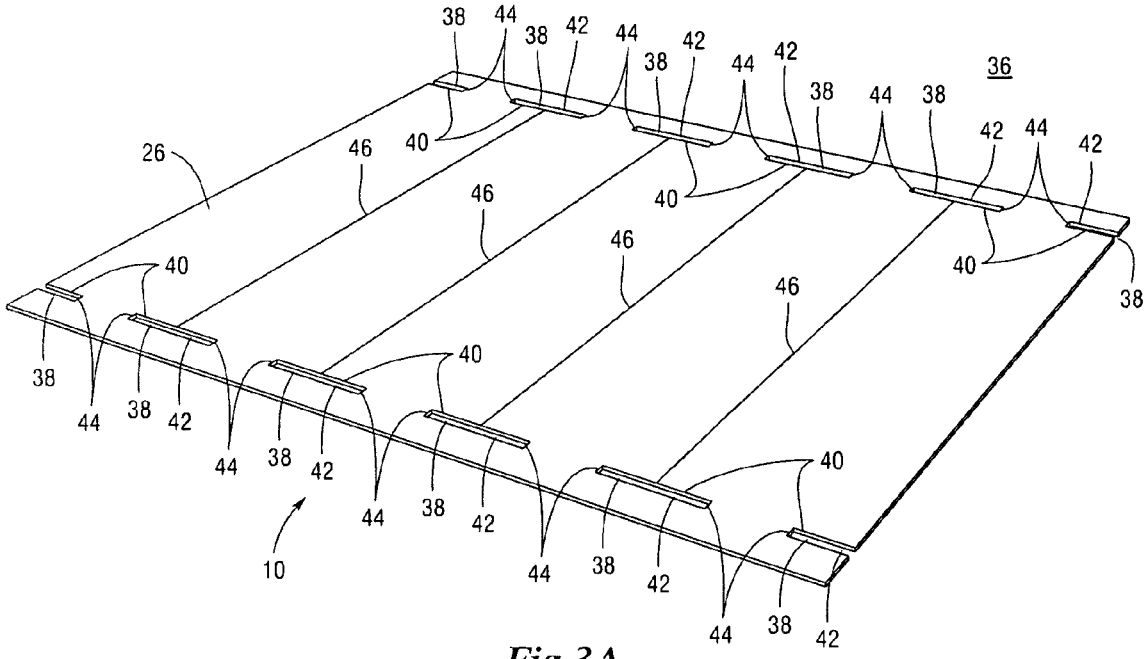
FIG. 3A is a perspective view of a piece of sheet metal cut where indicated.
Figure 3B:
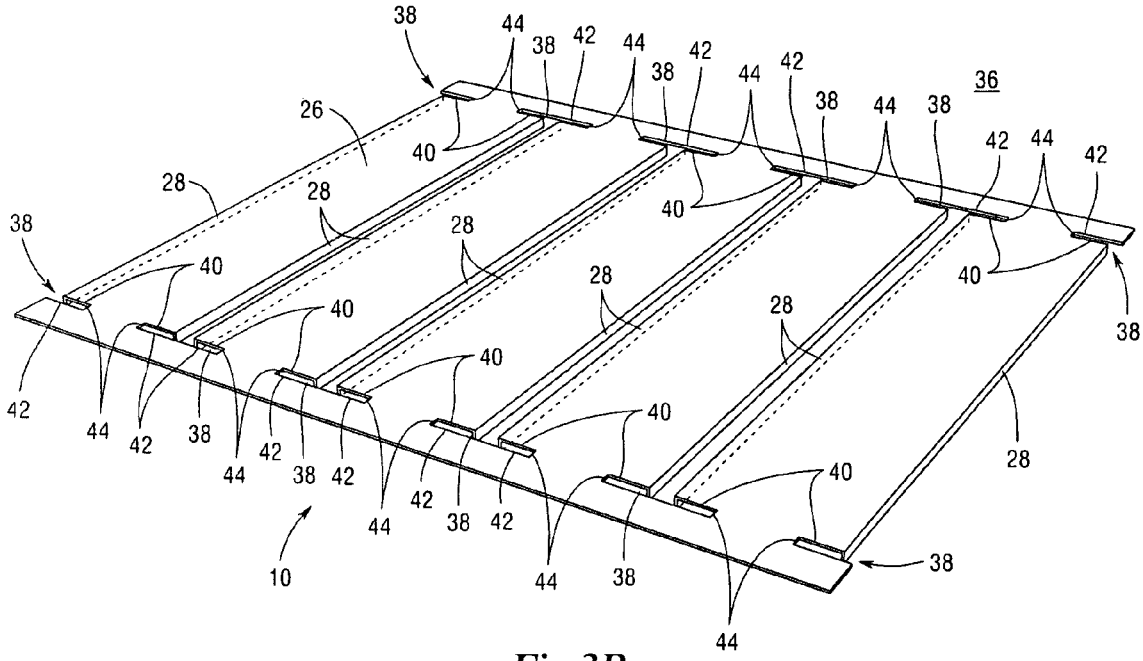
FIG. 3B is a perspective view of the piece of sheet metal shown in FIG. 3A showing the first sequence of folds in the formation of the decking.
Figure 3C:
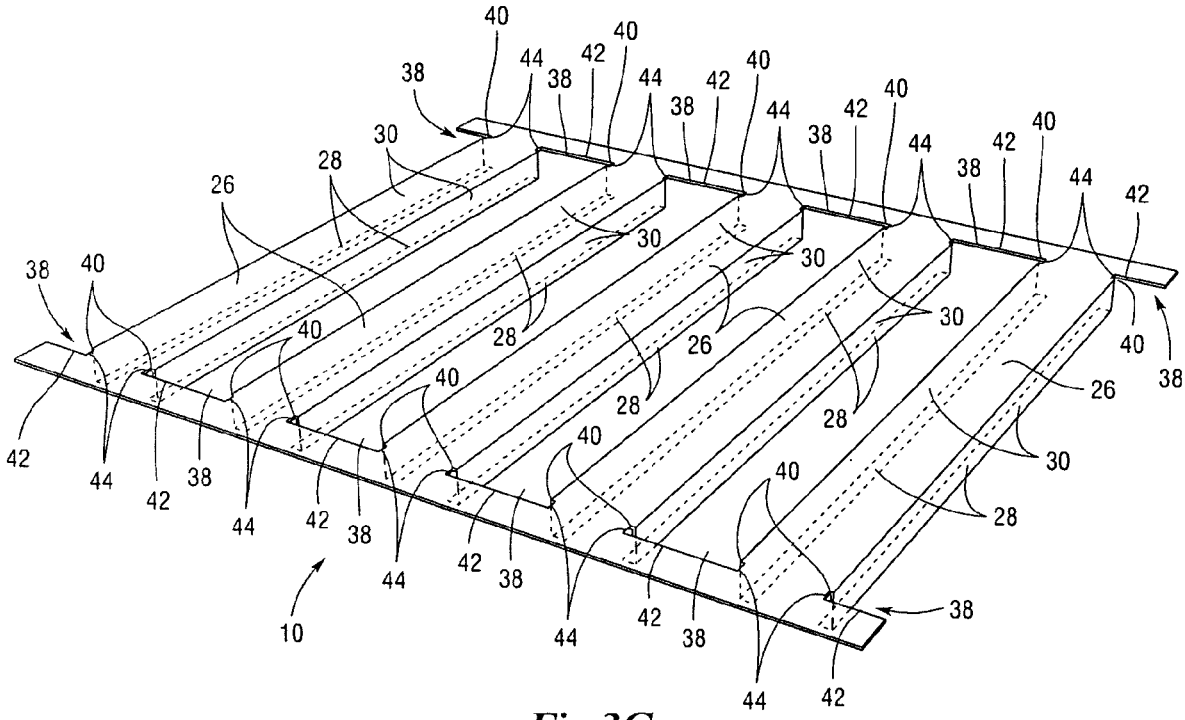
FIG. 3C is a perspective view of the piece of sheet metal shown in FIG. 3A showing the second sequence of folds in the formation of the decking.

The sheet metal 36 is then cut from about the center of inner edge 40 of each pair of rectangular holes 38 along a centerline 46 as shown in FIG. 3A. A portion of the sheet metal 36 on either side of the centerline 46 shown in FIG. 3A is then bent as shown in FIG. 3B at an angle of about 90° from the upper deck surface 26, to define what will become the lower deck surface 28 of the decking 10 as shown in FIG. 2B. The next bend is shown in FIG. 3C: a portion of the sheet metal 36 adjacent the lower deck surfaces 28 is bent at an angle of about 90° from the upper deck surface 26, to define the sidewalls 30 of the deck members 22 as shown in FIG. 2A.

Figure 3D:
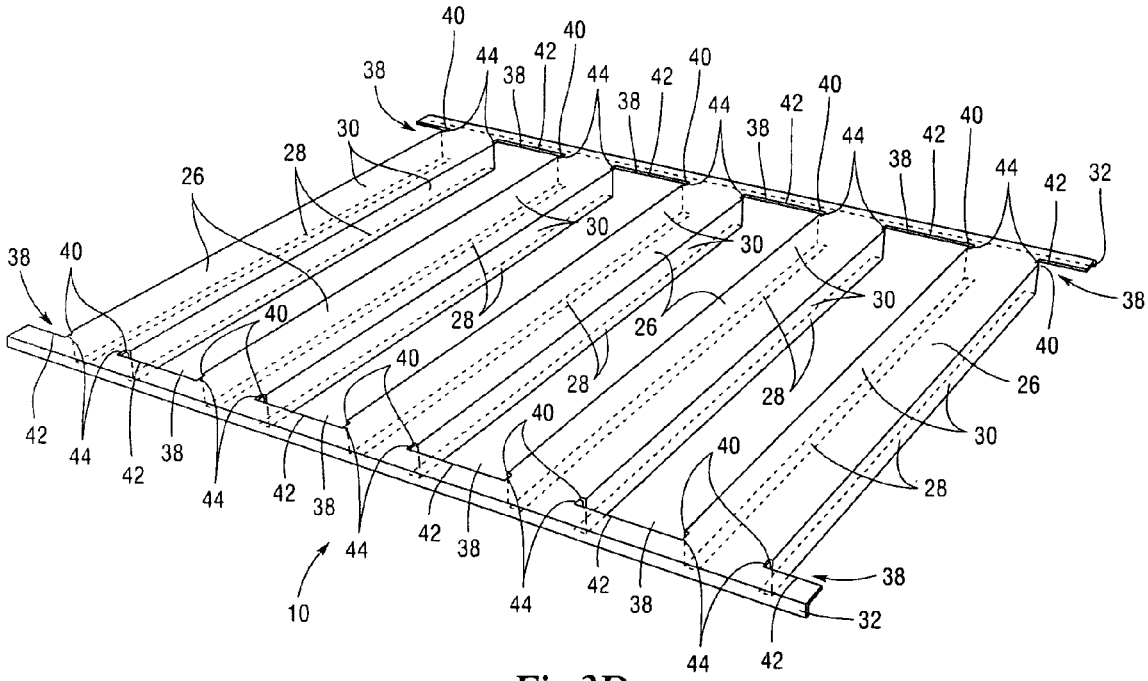
FIG. 3D is a perspective view of the piece of sheet metal shown in FIG. 3A showing the third sequence of folds in the formation of the decking.
Figure 3E:
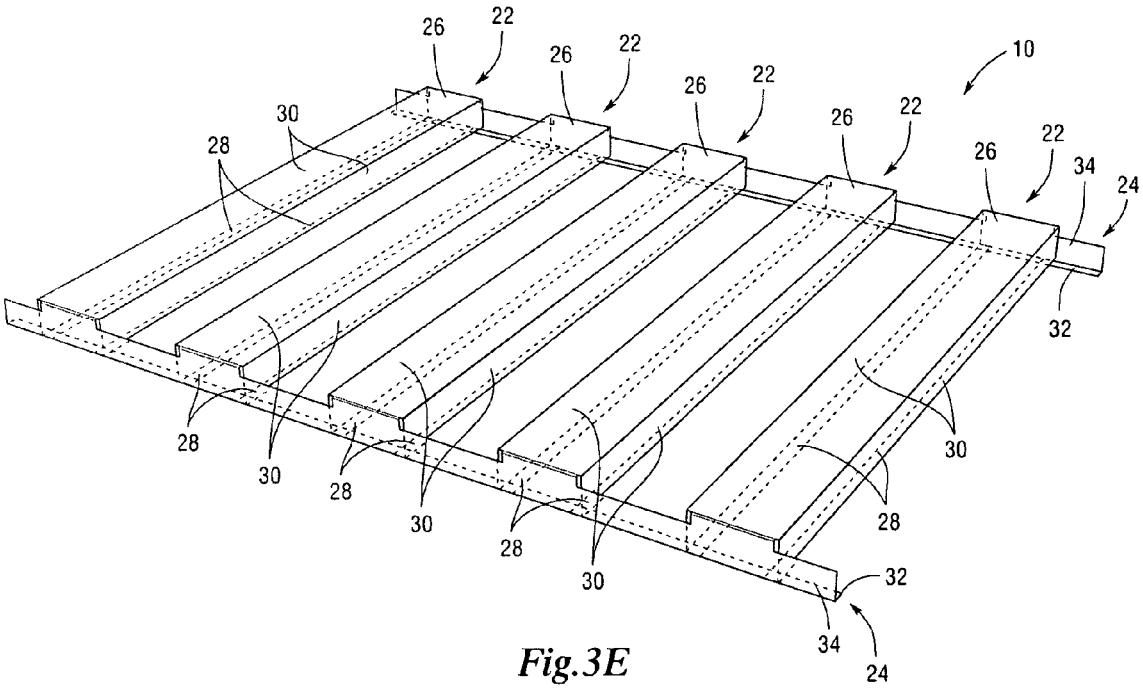
FIG. 3E is a perspective view of the piece of sheet metal shown in FIG. 3A showing the fourth sequence of folds in the formation of the decking.

The next step is the formation of the side rails, as shown in FIG. 3D: a portion of the outer edges of the sheet metal 36 is bent at an angle of about 90° from the upper deck surface 26, to define what will become the lower rail surfaces 32 best shown in FIG. 2B. The final bend is shown in FIG. 3E: the sheet metal 36 is bent along the sides 44 of the rectangular holes 38, about perpendicular to the upper deck surface 26, to define side rail surfaces 34. The lower rail surfaces 32 are slid against a portion of the lower deck surface 28 of the decking 10 as shown in FIGS. 2B and 3E. The lower rail surface 32 is then fastened to the lower deck surface 28 by any suitable method, including, but not limited to, spot welding, crimping, bolting, riveting, screwing, nailing, etc.

Figure 4:
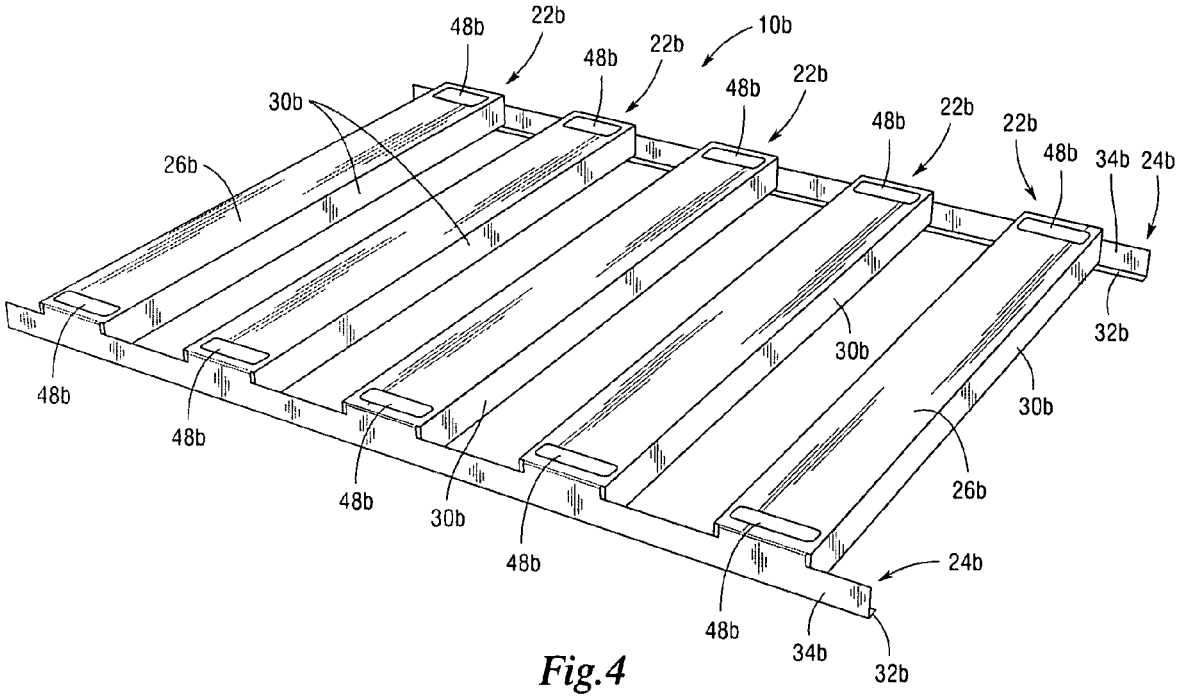
FIG. 4 is a perspective view of an embodiment of the decking in which the upper deck surface has an opening near the cross rails to allow access to the lower rail surfaces.

Various embodiments of decking 10 are possible to provide better access to the point of connection between the lower rail surface 32 and the lower deck surface 28. For example, access holes 48*b* can be cut into the upper deck surface 26*b* as shown in FIG. 4. These access holes 48*b* allow for easier assembly of the decking 10*b* if using fasteners such as nuts and bolts.

Figure 5:
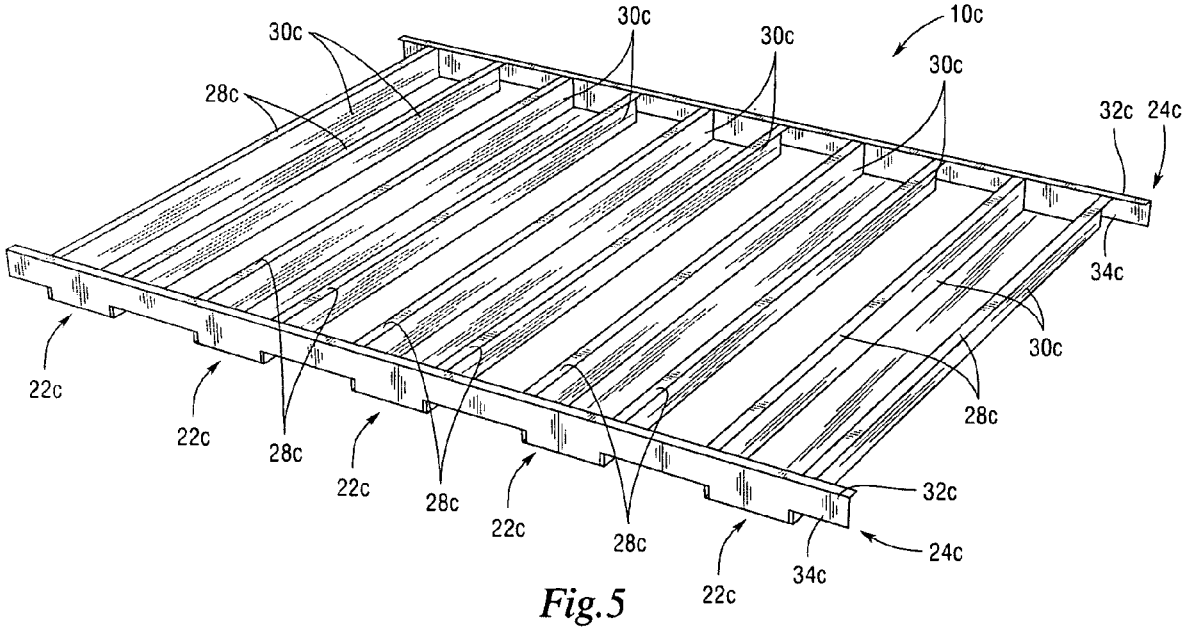
FIG. 5 is a perspective view of an embodiment of the decking in which the lower deck surface of the decking is bent outwards.

FIG. 5 shows the underside of another alternative embodiment of the decking 10*c*. In this instance, during the assembly of the decking 10*c*, the portion of the sheet metal that forms the lower deck surface 26*c* is bent outwards to extended into the space between the deck members 22*c*. As an increased safety measure, the edges of the lower deck surface 26*c* can be rolled over to reduce user exposure to sharp edges.

Figure 6:
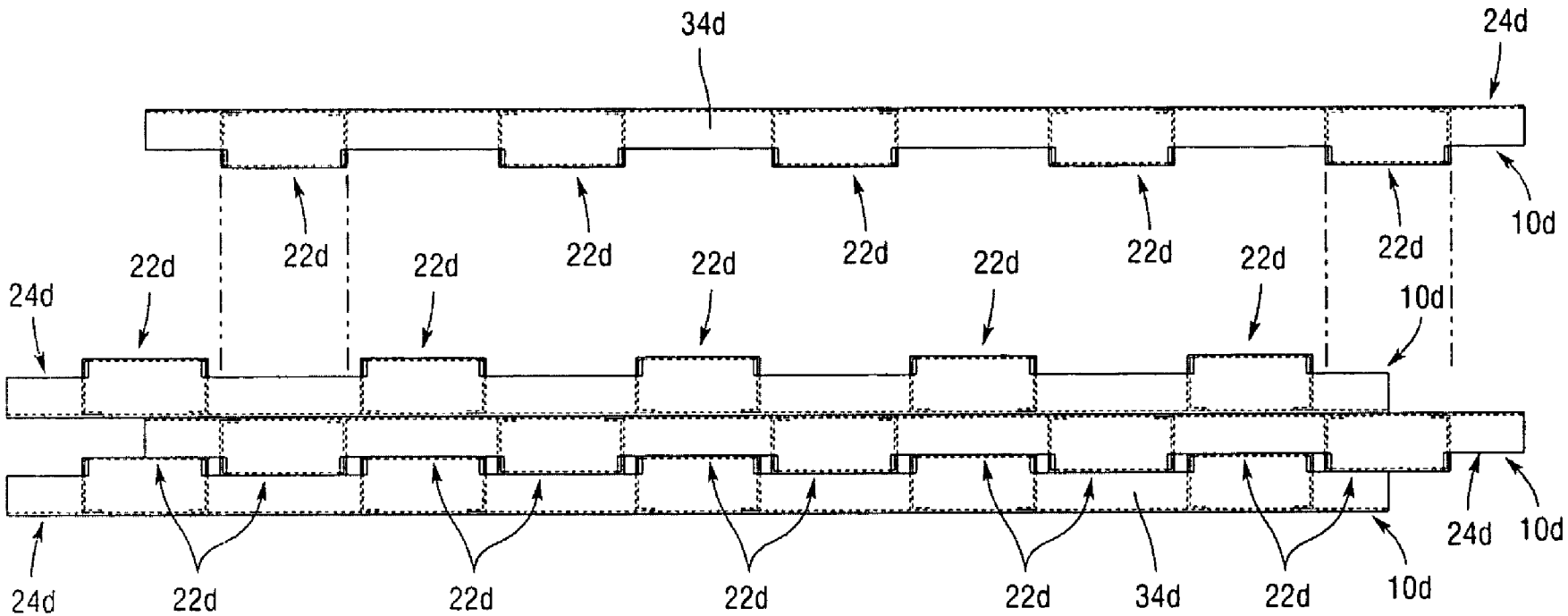
FIG. 6 is a perspective view of an embodiment of the decking in which several pieces of decking are stacked for transport.

Certain embodiments of the decking 10*d* allow for easier transportation and shipping. FIG. 6 shows four units of decking 10*d* stacked for shipping with alternating units of decking 10*d* inverted and aligned such that the deck members 22*d* of each unit of decking 10*e* fits between the deck members 22*d* of the inverted unit it is stacked with. This configuration reduces the profile, and therefore also reduces the required shipping and storage space, for multiple units of decking 10*d*. In these embodiments, the space between the deck members 22*d* is at least equal to, if not slightly larger, than the width of the deck members 22*d*. The sheet metal is also cut such that when it is bent to form the cross rails 24*d*, the side rail surface 34*d* between the deck members 22*d* is lower than the upper deck surface 26*d*.

Figure 7:
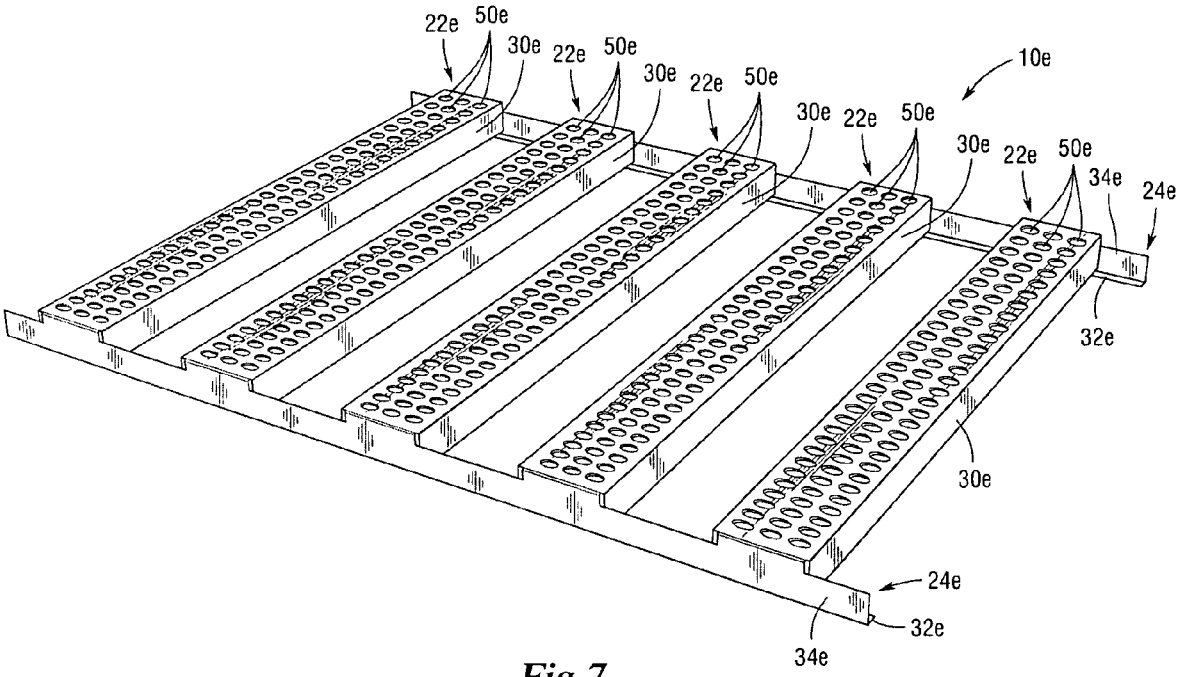
FIG. 7 is a perspective view of an embodiment of the decking having a perforated upper deck surface.

Fire safety codes in many jurisdictions require that at least 50% of the surface of storage rack shelves or decking must be open space in industrial and commercial settings to allow for the passage of fire suppressants to lower level storage areas in multi-tiered storage bays. If additional open space is required, the upper deck surface 26*e* can be perforated with holes 50*e* as shown in FIG. 7. While the holes 50*e* shown in FIG. 7 are circular in shape, the exact size, shape, number, and location of each hole 50*e* can be varied as demanded by the particular application. For example, the holes 50*e* can be oval, square, rectangular, or a combination of different shapes.

Figure 8A:
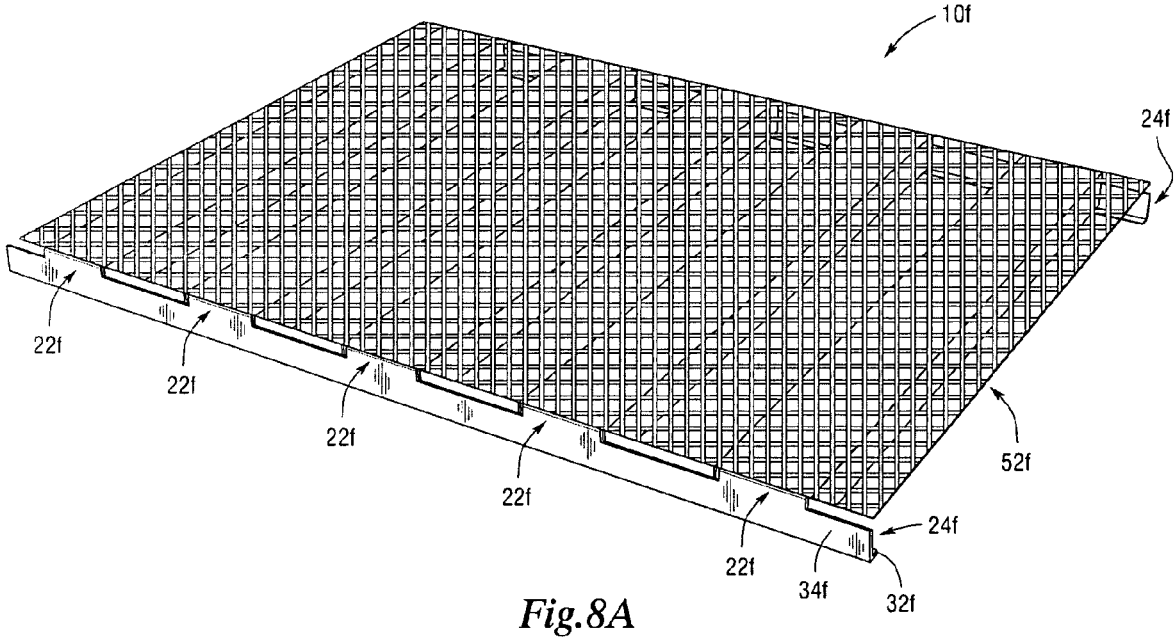
FIG. 8A is a perspective view of an embodiment of the decking having a capped upper deck surface.
Figure 8B:
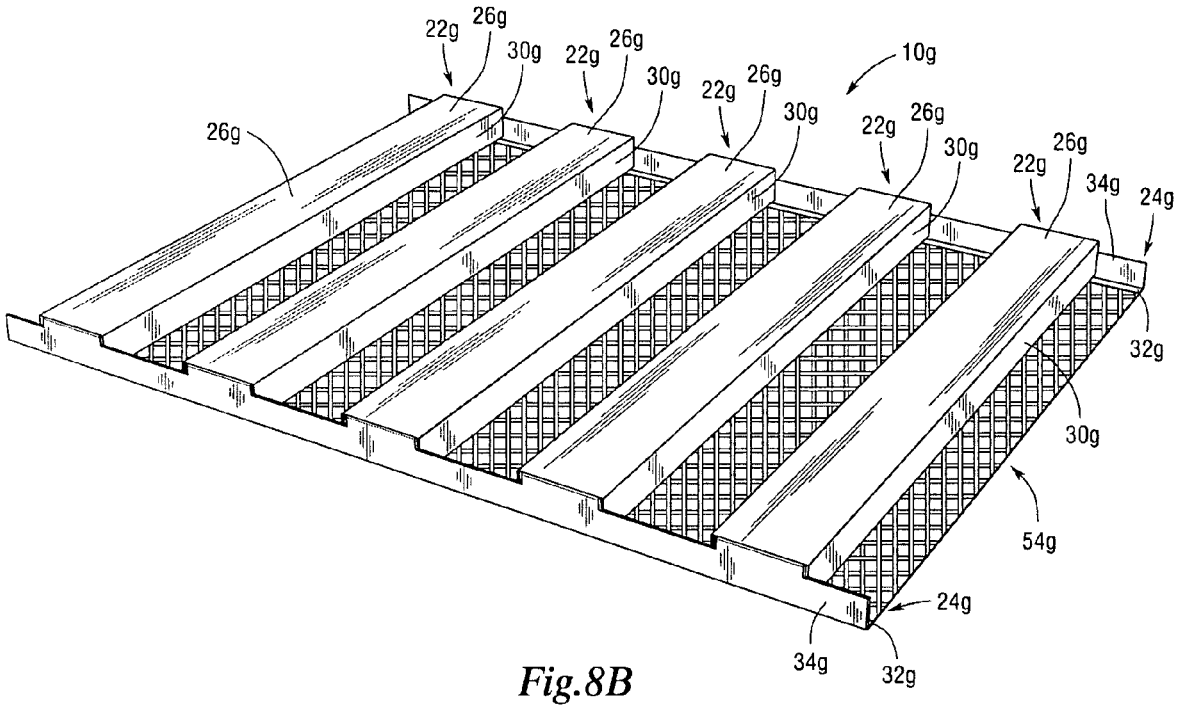
FIG. 8B is a perspective view of an embodiment of the decking having a capped lower deck surface.

FIG. 8A shows how the decking 10*f* could be further modified to include a cap 52*f* mounted on top of the decking 10*f*. Alternatively, FIG. 8B shows how the decking 10*g* could be modified to have a base 54*g* on the underside of the decking 10*g* that serves the same purpose as the cap 52*f*. The cap 52*f* or the base 54*g* can be a perforated sheet, an expanded metal mesh, an extruded wire mesh, or any other cap or base required by the particular application. These caps 52*f* or the bases 54*g* are useful in applications where the product to be stored on the decking 10*f*, 10*g* is smaller than spacing between the deck members 22*f*, 22*g*.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. In combination, decking for a storage rack system, and the storage rack system comprising a plurality of vertical columns and a plurality of horizontal step beams that define at least one storage bay, each step beam having a lip onto which the decking is mounted to form a storage shelf, the decking comprising:

a single sheet of sheet metal cut and folded to form a plurality of parallel deck members, each said deck member having an upper deck surface, a lower deck surface, and sidewalls;

said single sheet of sheet metal further folded to form two cross rails perpendicular to said deck members, said cross rails at either end of said deck members, each said cross rail comprising a lower rail surface and a side rail surface, each said lower rail surface overlapping at least a portion of said lower deck surface of said deck members; and said lower rail surface secured to said lower deck surface at the overlap of said lower rail surface and said lower deck surface.

2. The decking of claim 1 in which said lower rail surface is secured to said lower deck surface at the overlap of said lower rail surface and said lower deck surface by any of spot welding, riveting, crimping, bolting, screwing, or nailing.

3. The decking of claim 1 further comprising access holes on said upper deck surface of said deck members to allow access to the overlap of said lower rail surface and said lower deck surface.

4. The decking of claim 1 in which said side rail surface between said deck members is lower than said upper deck surface and the space between said deck members at least equal to the width of said deck members.

5. The decking of claim 1 further comprising a cap mounted on top of the decking.

6. The decking of claim 1 further comprising a cap mounted on top of the decking, said cap comprises one of a perforated sheet, an expanded metal mesh, or an extruded wire mesh.

7. The decking of claim 1 further comprising a base mounted to said lower deck surface.

8. The decking of claim 1 further comprising a base mounted to said lower deck surface, said base comprises one of a perforated sheet, an expanded metal mesh, or an extruded wire mesh.

9. The decking of claim 1 in which said deck members are sized and spaced to create an at least 50% open area rack deck.

10. The decking of claim 1 wherein said upper deck surface is perforated.

* * * * *